114-253
6/30/81 XR 4,275,677 SR

United States Patent [19]
Nelson

[11] 4,275,677
[45] Jun. 30, 1981

[54] TOW OF BARGES BY TUGS

[76] Inventor: Arthur J. Nelson, 849 W. Orange, South San Francisco, Calif. 94080

[21] Appl. No.: 637

[22] Filed: Jan. 2, 1979

[51] Int. Cl.³ ..... B63B 21/56
[52] U.S. Cl. ..... 114/246; 114/253
[58] Field of Search ..... 114/246, 249, 250, 251, 114/144 R, 253, 254; 244/1 TD, 3; 273/105.3; 280/462, 480, 491 F, 456 R; 24/115 R, 115 H

[56] References Cited

U.S. PATENT DOCUMENTS

| | | | |
|---|---|---|---|
| 2,318,150 | 5/1943 | Foss | 114/253 |
| 2,973,403 | 2/1961 | Taylor | 24/115 R X |
| 3,336,895 | 8/1967 | Nelson | 114/246 |
| 3,407,778 | 10/1968 | Epstein et al. | 114/253 |
| 3,492,964 | 2/1970 | Garcia | 114/251 X |
| 3,611,977 | 10/1971 | Mosuold | 114/246 |
| 3,745,958 | 7/1973 | Nelson | 114/246 |

FOREIGN PATENT DOCUMENTS

| | | | |
|---|---|---|---|
| 1348069 | 3/1974 | United Kingdom | 114/251 |

*Primary Examiner*—Sherman D. Basinger
*Attorney, Agent, or Firm*—Naylor, Neal & Vilkema

[57] ABSTRACT

A readily alterable arrangement, to suit the need at sea and in coastal inlet passages for control and disposition of vessels, comprises: pulled barges outfitted with a condition responsive linkage mechanism for implementing a rudder, towlines conveying propulsive force to barges, and tugs continually employed in tow or exchange of barges being loaded/unloaded in the interim of tug port calls. The linkage mechanism, dependent upon a pivotal beam mounted forwardly of the barge mass center, imparts propulsive force on the longitudinal centerline or at either barge side as transmitted to the pivotal beam ends by a bridle leg arranged towline terminal. Alternative assemblies comprise: coupled bridle legs by a flounder plate for a single towline to effect automatic barge control at sea, connection of bridle legs as separated extensions for dual towlines adjustably lengthened for selective control of barge rudders in sheltered waters and employing duel towlines for double tow of barges automatically controlled at sea. The arrangements also comprise a system to effect changes from one to two towlines, a system to interchange barges and a system to back and moor barges—all to provide an operative arrangement adjusted to the sequence of encounters to complete a voyage.

7 Claims, 33 Drawing Figures

Fig 7
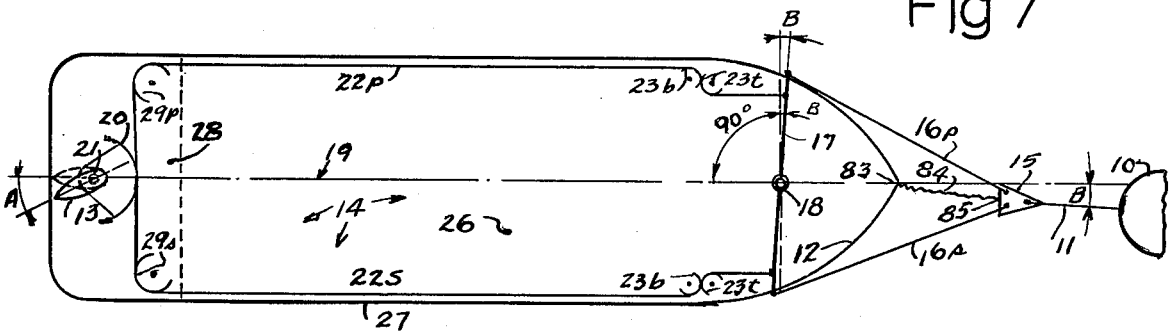
(7a)
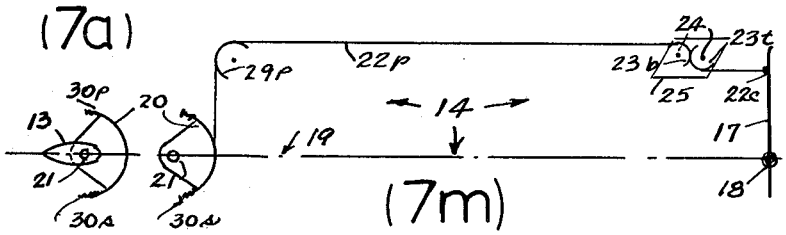
(7m)
(7f)
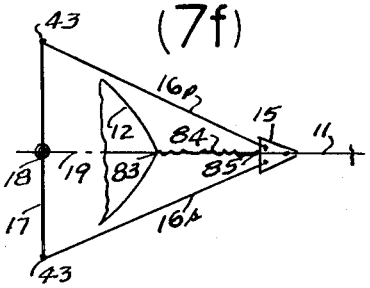
Fig8
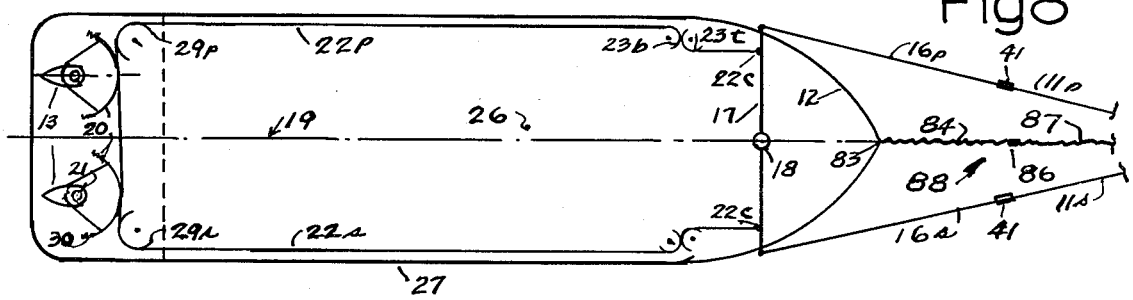
Fig20
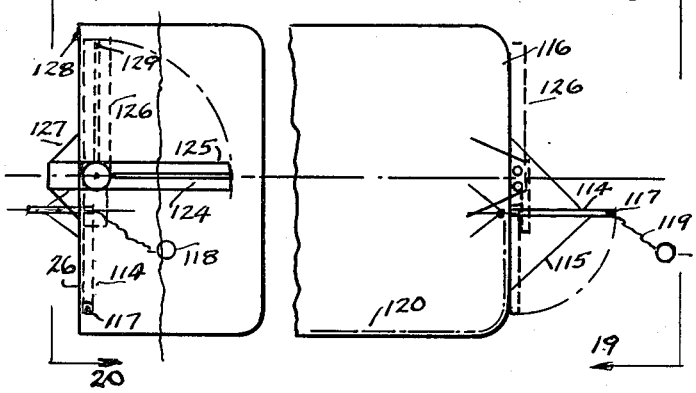
Fig19
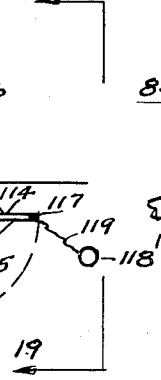
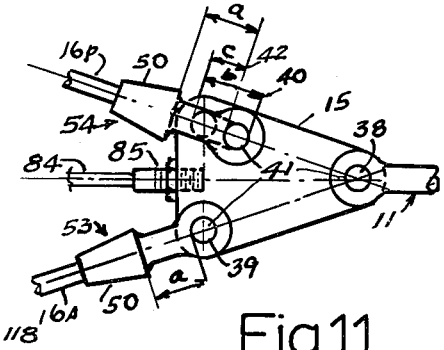
Fig11

51
13
50
57
62
68
16a
52
56
61
60
67
58
16p
13
50
46

12
16a
s
61
16p
57
62
49
65
64
50
47
50
12
R
63
s
112
60
53
a
85
p
48
54
42
40
b
c
a
39
15
55

TOW OF BARGES BY TUGS

CROSS REFERENCES AND IMPORT OF THE PRESENT APPLICATION TO THEM

My U.S. Pat. No. 3,336,895; noted herein as (Ref. A)
My U.S. Pat. No. 3,745,958; noted herein as (Ref. B)

The present application pertains to an improved arrangement of the linkage mechanism which more aptly adjusts to a need, simplifies installation and lessens construction costs. This application contends with completing a voyage requiring various arrangements, alterable enroute, to suit encounters at sea and coastal inlet to optimize safety and minimize incidents of obstruction, damage and injury. The format adopted herein establishes enumerated arrangements with correspondingly figured drawings which are delineated one time for connotation of its use when applied in the disclosure and establishes distinction among 6 arrangements.

BACKGROUND OF THE INVENTION

1. Field of the Invention

The present application relates to the mode of transporting waterborne cargo by fulfilling the dual time consuming function, to bear and move cargo, as separated functions undertaken by vessels applied solely for the one specific function. The basic concept pertains to a train of vessels: led by a tug to provide motivation of the train, and towed unmanned barges formed with shipshaped forebodies and having stern mounted rudders providing directional control of barges as monitored by towlines interconnecting tugs and barges.

Operator demands in addition to a patent requirement to be novel, useful and operable are that equipment be reliable, productive and especially to be simple to construct and maintain. A pivotal beam is the crux of the system, providing diverse arrangements to control and regroup barges in a train destined for several ports in a voyage, being the combinator of propelling and steering elements and serves as the intermediary in the linkage with the towline to implement the rudder.

2. Description of the Prior Art

Self-propelled, self-sufficient ships perform said dual time consuming function sequentially for a cumulative time lapse to foster the sense of haste. Configuration of the ship hull to accommodate the stern mounted propeller, propelling and steering gear, sundries to effect self-sufficiency, speed to handle cargo and cover distances—are all detractive factors to productivity and conservation of energy.

Subsequent development of barges with skegs and "pushed" barges aborted best features of its precedent to nullify advantages sought. Despite advent of the 'Kort' nozzle and controllable pitch propellers, innovations have been only minorly benefitting moderately sized cargo vessels. The principal fault is the mode of propulsion with the propeller aft to push vessels—charged with numerous adverse factors. Contrarily, despite prejudiced notions, the tenacity of towlines to fulfill its function—to pull barges—is excellent; as attested by: its required inclusion with "pushed" barges as the means to be used in heavy weather, and its good service record towing skeg fitted barges despite abuses and improper use.

SUMMARY OF INVENTION

The mode of exchanging barges at a port allows for a time concurrent operation of tugs continually employed to move barges while cargo is being worked with other barges to be entrained. A more orderly and sensible operation develops, to avoid the sense of haste, lessens concern over port consequentials, and affords time to care for 'gear' between stages working cargo in the interim of tug port calls to effect barge exchanges.

The practice to exchange barges is made economically feasible because of merits with the linkage mechanism which restores use of the shipshaped forebody and rudder to towed vessels. A simpler full formed afterbody, without concern for water flow to propeller aft, improves seakeepiness to ameliorate pitching to lessen slamming of the less susceptible forebody. A resultant increased displacement is augmented with increased cargo capacity by supplanting burdensome appurtenances of self-propelled manned ships with the insignificantly weighing linkage mechanism.

Consequently, a single tug and barge fitted with the linkage mechanism transports a third more cargo, bears half the labor cost, consumes about a fourth the fuel oil than a ship sized with the barge. Multiple tow of barges even more outstrips performances of more numerous ships.

Improvements with the present invention provide for a desirable limit to pivotal beam angular deflection to a nominal value for a maximum rudder angular deflection still virtually free of hydrodynamically applied torsional load.

A prime object is the overall performance of a train of tugs and barges achieved by alterable train arrangements for control, disposition and regrouping barges.

A principal object is relocation of the pivotal beam to simplify its mounting upon a barge and to facilitate selective arrangement of the linkage mechanism between towline and rudder.

Another object is to adapt said selective arrangement for its elements to be disposed to isolated locations free of interference to cargo handling or its disposition while maintaining watertight integrity of hull and compartmentation of holds.

Another object is to provide the operational means needed to achieve the said prime object, the basis of the present application.

Another object is to provide an 'A' framed pivotal extension from the tug stern expeditiously connected to the barge bow (stem) to facilitate maneuvering and manning the barge to and from a dock.

NUMERICAL LIST OF EXPRESSIONS (DEFINED)

Six arrangements are enumerated and defined for a subsequent simplified expression of its practice and to clearly distinguish the mode of assembly. The basic arrangement of the linkage mechanism common to all arrangements is developed subsequently to precede "General Description."

Arrangement (1)—AUTOMATIC BARGE CONTROL—the simplest arrangement employed at sea with a flounder plate connecting a towline to equal length bridle legs mounted to the ends of said pivotal beam for a constant configured assembly of the towline to the pivotal beam.

Arrangement (2)—DOUBLE TOW—a simple change to Arrangement (1), being: double tow of the barges each by a towline effecting automatic barge control, whereby barges are caused to trail oppositely off the center of the tug wake, one aft of the other with the near barge clear of the more extended towline, and the two barges independently respond directionally in oblique, parallel spaced patterns with miniscule yaw deviation for directional stability.

Arrangement (3)—SELECTIVE CONTROL—the tow of a barge in coastal inlets (sheltered waters) by two towlines connected as extendable lengths of separated bridle legs to afford selective manipulation of the barge rudder by duplicate traction winches aboard the tug to divert the barge at will.

Arrangement (4)—SUPPLEMENTAL CONTROL—this practice is applied with above Arrangements (1, 2 & 3) to augment a rudders ability to turn a barge, a shift in location of applied propulsion:

(a) This occurs automatically when the tug changes heading substantially to cause the single towline of (1 & 2) to act through a single bridle leg (the other relaxed). A stop limits the amount of deflection of said pivotal beam to alter the constant figured Arrangement (1 & 2), so that propulsion shifts to a barge side from the central location of (1 & 2) to create a turning couple assisting the rudder at maximum deflection to turn the barge.

(b) This applies selectively with two towlines of Arrangement (3) when one towline is relaxed, moderately or completely, for a dominant amount of propulsion applied to one barge side to create a like assisting turning couple of Arrangement (4a).

Arrangement (5)—INTEGRATED TOW—a tug is effectively lengthened by a pivotal 'A' frame mounted on the tug stern rail for universal connection to a selected one of a number of padeyes fixed to the barge bow (stem), depending upon the barge draft to effect substantially a horizontal frame position. Towline Arrangement (4*b*) applies as adapted for the prior and subsequent performance with maneuvers in sheltered waters to and from a dock.

Note the sequence of performances: Arrangement (1) or (2) at sea, changed to Arrangement (3) in confining passages, then changed to Arrangement (5) in mooring the barge, having resorted to Arrangement (4) with the need.

Arrangement (6)—TRIPLE TOW—a leading tug in tow of a barge assists a second tug in double tow of barges as a train to become separable in passing a port; for the lead tug and barge to effect exchange of barges, while the double tow continues on course to be overtaken by the single tow with the exchange barge. As arranged the overtaken tug then becomes the leading tug to assume the arrangement first established of becoming a subsequent occurrence of a single tow into a port for the second barge exchange.

DESCRIPTION OF DRAWINGS

The first six figures are plan views diagrammatically illustrating, exaggerated for a better visual image, progressive positions in undertaking a tow as set forth in the numerically listed arrangements.

the fre towline aboard tug (t) now to be connected to the bow of tug (l) for reversal of identities tug (t) now the leader termed tug (l) with barge (2) next destined for exchange.

FIG. 7 is a plan view schematically showing a tug in tow of a barge having a linkage mechanism connecting a single towline to a rudder for implementation per Arrangement (1). Sketches *7a, 7m* and *7f* are free body diagrams as segments of the linkage mechanism.

FIG. 8 is a plan view schematically showing a barge towed by dual towlines with the linkage mechanism, incidently, connected to dual rudders.

Figure 9:
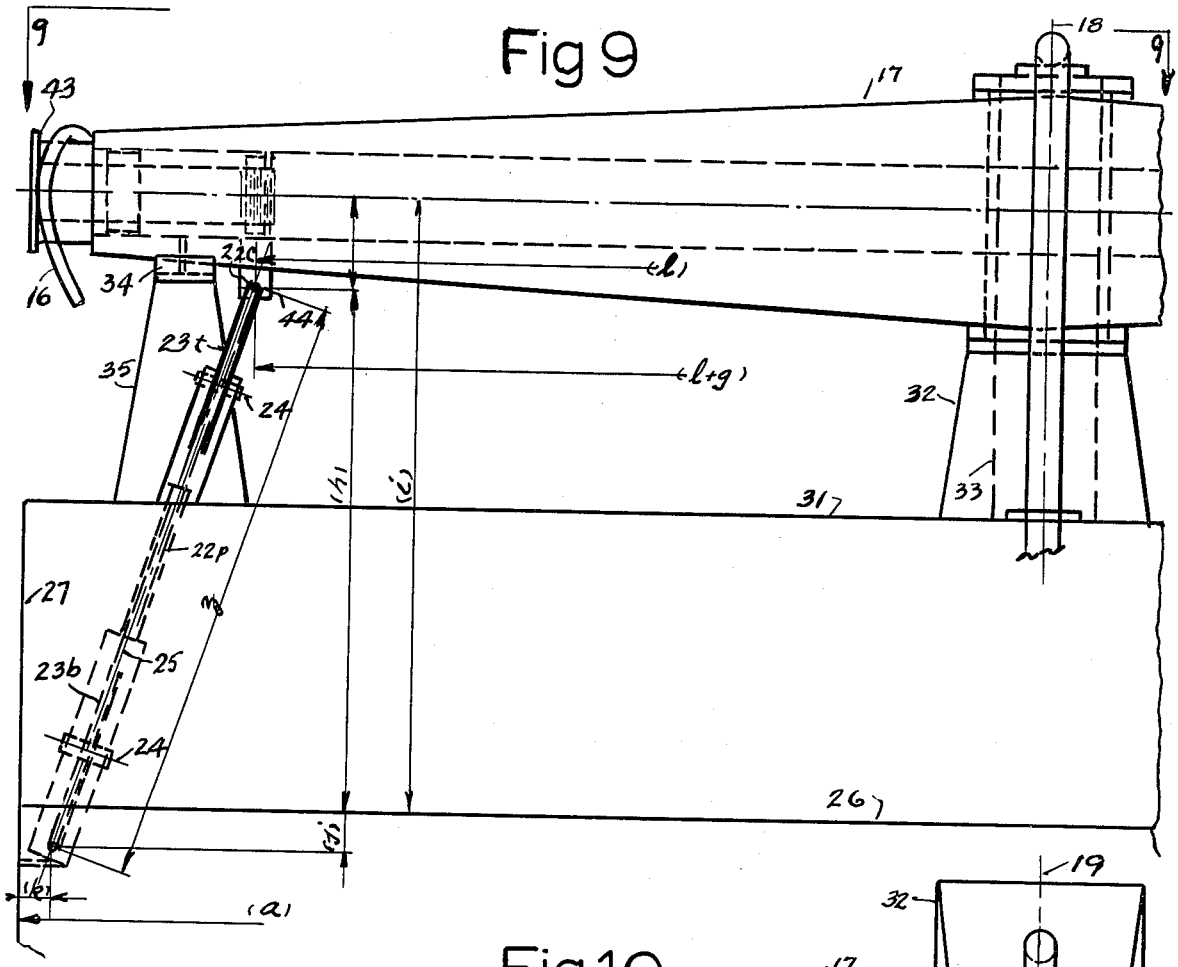
Figure 10:
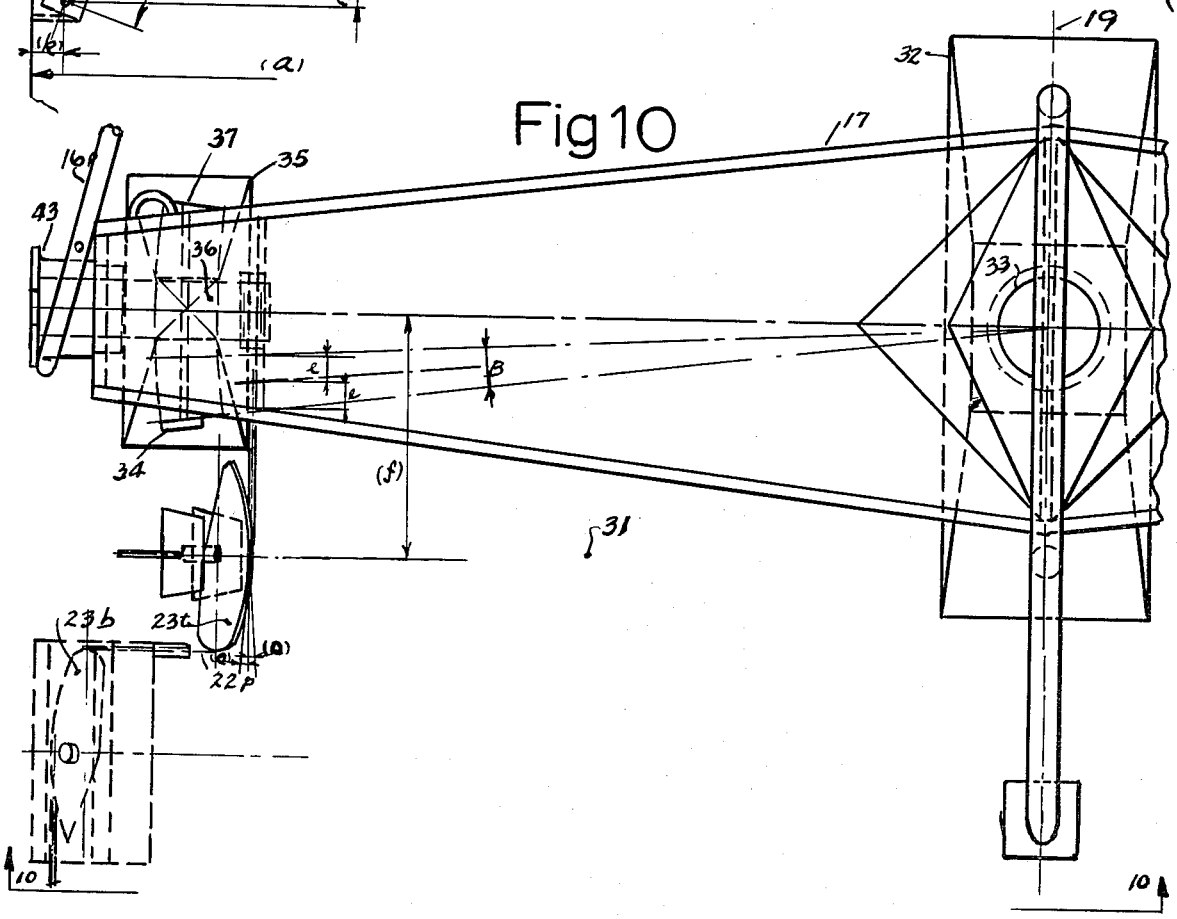

FIG. 9 is a partial elevational view (looking forward) of the pivotal beam and appurtenances taken from plane 10—10 of FIG. 10.

FIG. 10 is a partial plan view of the port side of the pivotal beam and appurtenance taken from plane 9—9 of FIG. 9.

FIG. 11 is a plan view of the flounder plate with portions of wire members.

Figure 12:
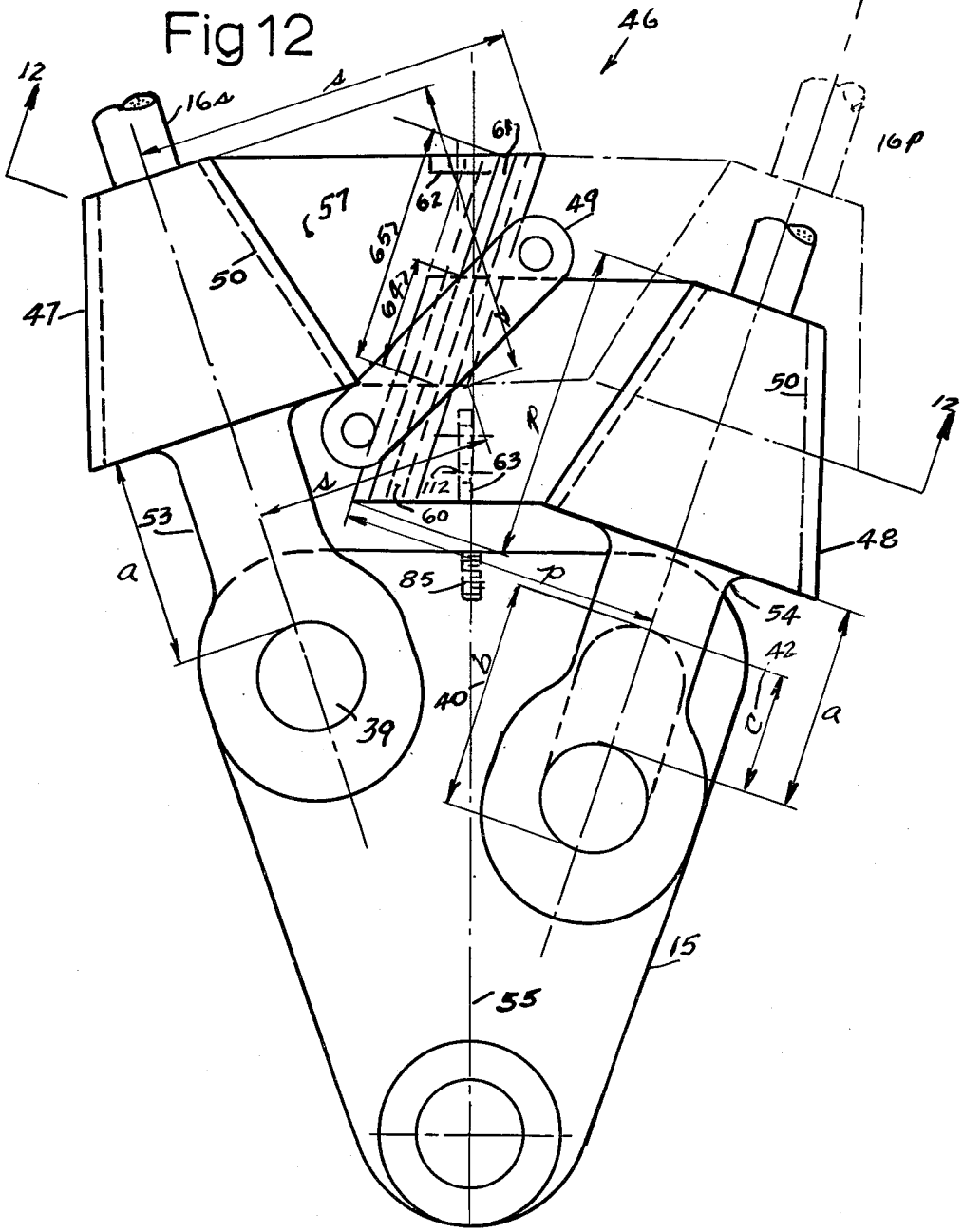

FIG. 12 is a plan view of the cufflink coupling socketed ends of bridle legs.

Figure 13:
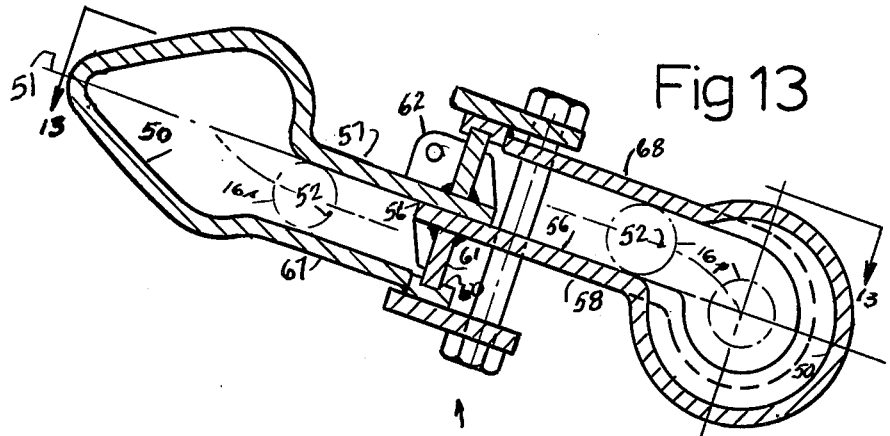

FIG. 13 is an end view of the cufflink taken from section 12—12 of FIG. 12.

Figure 15:
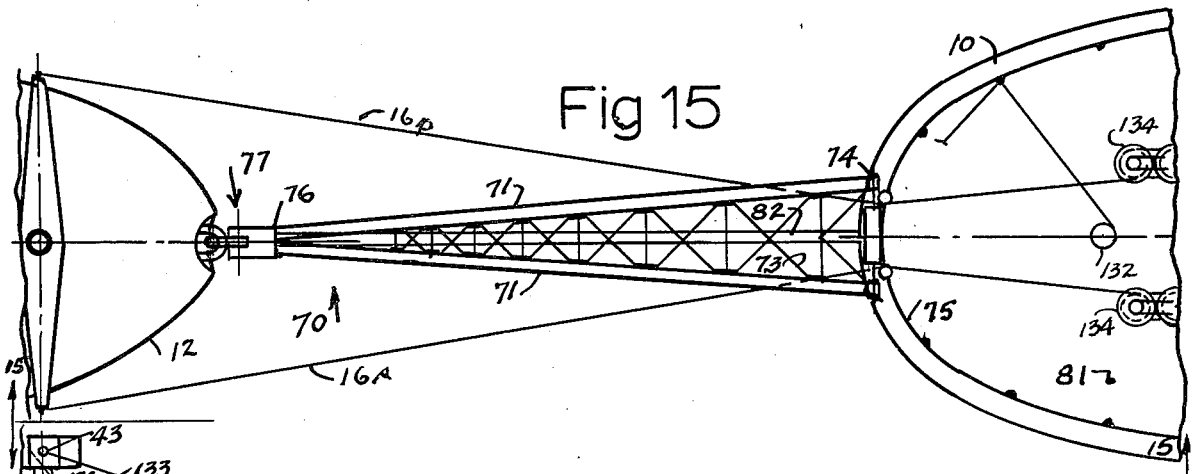
Figure 14:
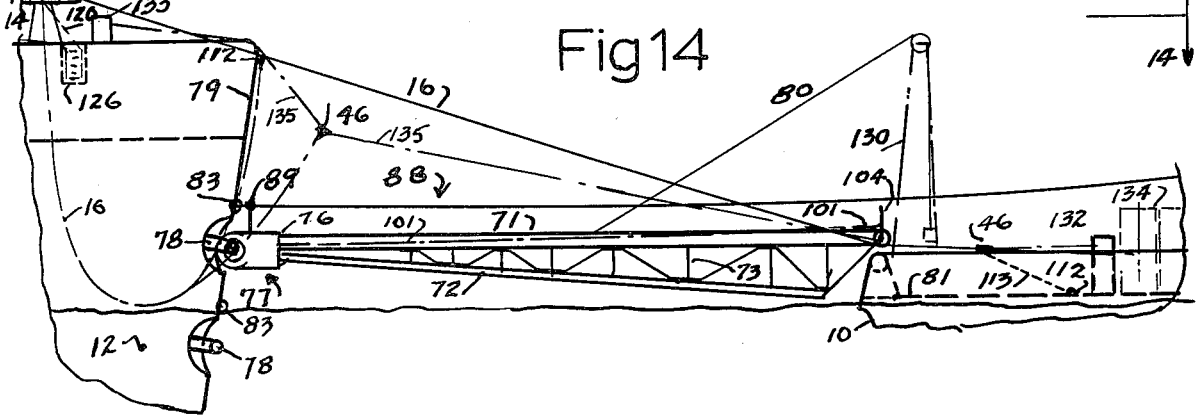

FIG. 14 is an elevation view of the 'A' frame integration of tug and barge taken from 15—15 of FIG. 15.

FIG. 15 is a plan view of the 'A' frame assembly taken from view 14—14 of FIG. 14.

Figure 16:
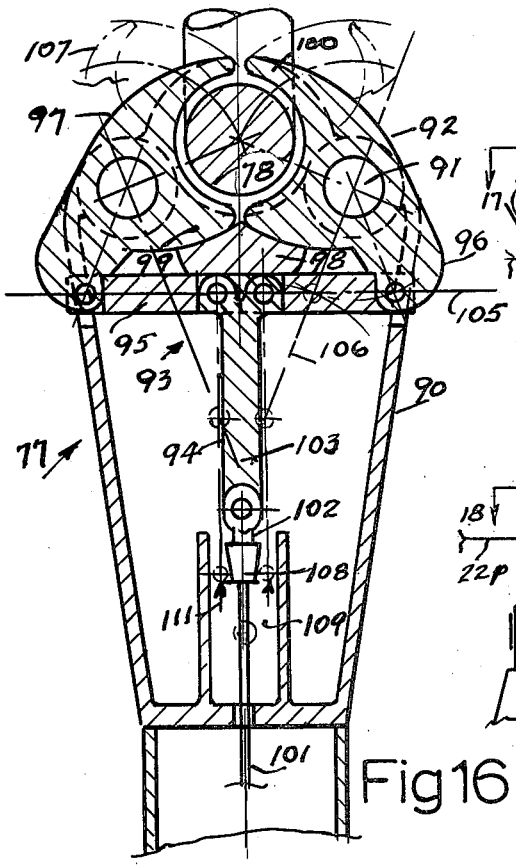

FIG. 16 is a cross sectional view of the universal clamp assembly.

Figure 17:
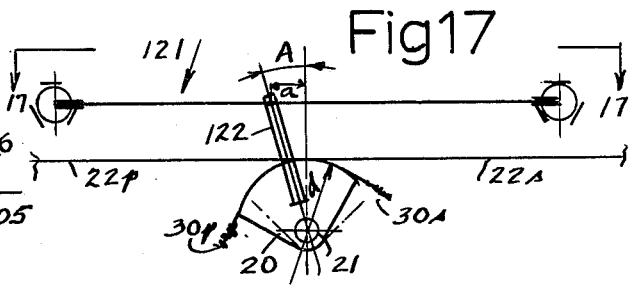

FIG. 17 is a plan view diagramatically illustrating the return to neutral system of the rudder with towline relaxed.

Figure 18:
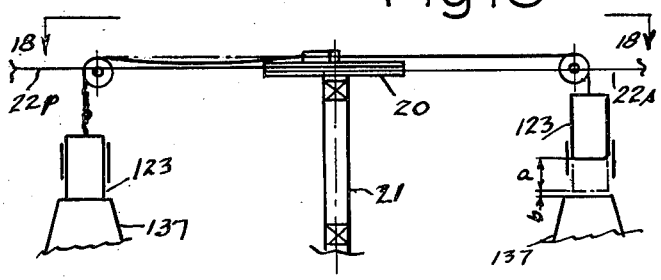

FIG. 18 is an elevational view 17—17 of FIG. 17.

FIG. 19 is a partial plan view diagramatically illustrating appurtenance arrangements to the stern of a barge.

FIG. 20 is an elevational end view of a barge taken 19—19 of FIG. 19.

CONCEPT (FIG. 1)

The basic concept is a linkage mechanism established to a regular configuration comprising aligned members, which when transformed by external behaviors, activates a rudder to maintain directional stability of a barge being towed by a tug with a towline.

The towline is virtually the monitor of the system, being the connecting member of the two vessels. Tug heading change or barge sheer (yaw) off-course (the external behaviors) effects misalignment between towline and barge thereby transforming configuration of the linkage mechanism comprised of three segments.

For the posture of automatic directional stability in contention with barge yaw off-course set by the tug, the forward segment (of the three) retains a constant configuration of towline with bridle connected to the ends of a pivotal beam fixed above deck on the longitudinal centerline and forward of the barge mass center.

The pivotal mounting of the forward segment (*7f*) establishes its constant configuration through unrestraint rotation to a maximum angular deflection (B) when the forwardly moving beam end abuts a stop. This stop fixes maximum rudder angularity (A) and transposes propulsion from the pivot axis to the barge side by the behavior of the tug to change course. Configuration of the forward segment has then been changed to relax one leg of the bridle and fix the other bridle leg as a direct extension of the towline.

The directional control after segment (*7a*), having a bearing supported rudder stock to provide for the pivotal mounting and torsional resistance between a rudder quadrant and said rudder, is relieved of hydrodynamic torsional loading with the limited angular deflection (A) containing the center of pressure of water to act along the pivotal axis.

A pair of aft wires extend, symmetrically arranged for the mid segment (*7m*) of said linkage mechanism 14, from a forward end connection with the above deck pivotal beam to a rearmost beam deck compartment having grooved sheave segments about which the aft wires bend for an athwartship reach past each other to adjustable connections with the pivotal rudder quadrant.

These aft wires are pretensioned and adjusted to establish a regular mid segment configuration with the pivotal beam established at right angles to the rudder then set aligned with the barge centerline and tensioned towline.

Sheer of the barge off-course (yawing) alters the barge alignment with the forward segment to establish the angular deflection (B) between the pivotal beam and a transversal through the pivot axis. Geometrically the angular deflection (B) is the same for the towline misaligned departure from the barge centerline. Angular departure (C) of the barge off-course and a resulting disposition of the towline off-course for a deflection angle (F) are triangularly related as (B=C+F).

Large spans (l) between said aft wire end connections to the pivotal beam with miniscule angular deflection (B) establish the arc travel of said connection insignificantly different from the forward movement of the connection—the displacement or pull of the aft wire, linearly (e).

With $(B)=2°$; $\pi lB \div 360 = \frac{1}{2} l \times \text{Tan}\ (B)$ or $0.0175 = 0.0175$ Optimal pitch diameter (d) of the grooved rudder quadrant is established by design considerations of the aft wire and consistency between allowable tensile and torsional stresses in associated members. Therefore a span (l) is developed by equalized arc travel of pivotal members:

$(\pi lB \div 360 = \pi dA \div 360)$ or $(l = dA \div B)$ ex:

with $A=20°$, $B=2°$, $l=10d$.

Appraisal

The crux of the linkage mechanism is the pivotal beam serving as the combinator of propelling and steering means, otherwise performed by separate massive mechanisms with complex appurtenances to burden self-propelled ships with displaced cargo. The simply calculable beam structure differentiates its dual function as the intermediary by distributing propulsive force specifically to a forward segment and controlled steering to an after segment, as monitored by aligned members when displaced by said external behaviors. Action between pivotal members is conveyed, by an equally excellent tool—wire rope—most conservatively applied in all considerations of its use.

The composition and configuration of a unified system, comprising two pivotal members, provides for miniscule deflections of the propulsion force transmitting forward segment for amplified deflection of the directional controlling after segment. Instantaneous response by the simple linkage mechanism when transformed by external behaviors minimizes those deflections for a rudder performance with least drag. Contrarily a ship rudder, dependant upon propeller wash, is sized to cope with turning circle demands, suffers time lag because of servo-mechanisms and delayed application with perplexities of human behavior (individually or communicatively).

GENERAL DESCRIPTION

FIG. 7, and its free body diagrams FIG. 7*f, m & a,* shows the general arrangement of a tug 10, providing propulsion, having a single towline 11 to pull barge 12 fitted with a rudder 13 which is connected by a linkage mechanism 14 to towline 11. Propulsion transmitting forward segment 7*f* includes the towline 11 connected to a flounder plate 15 serving as the vertex connection of bridle legs 16*p, s,* extending aft for connection to ends 43 of a pivotal beam 17 having its axis 18 established on the barge longitudinal centerline 19. Directional control aft segment 7*a* includes the pivotally mounted rudder 13 for torsional engagement with rudder quadrant 20 by bearing supported rudder stock 21. Mid segment 7*m* (representing the tie of end segments of linkage mechanism 14) depicts only the port side 22*p* of the dual symmetrically configured aft wires 22*p, s,* to afford an enlarged view and singular expression of an assembled pair of alike sheave segments 23*t, b,* having axes 24 perpendicular to a common plane 25. Configuration of wire 22*p* extends from a connection 22*c* with beam 17 to bend with sheave segments 23*t, b* for its lateral disposition along the shell 27 of barge 12 to extend aft to a rearmost compartment 28 containing aft sheave segment 29*p* about which the aft wire bends for an athwartship reach to adjustable connection 30*s* with quadrant 20. Aft wire 22 *p, s* are secured to sheave segments 23, 29 at the mid length of the grooved peripheral to prevent dislocation of contacted surfaces most conservatively arranged.

FIG. 9 shows the pivotal beam 17 mounted to the above deck structure 31 by a central pedestal 32 supporting trunnion 33 transmitting the centrally applied propulsive force to the barge. Above deck aft wire connections 22*c* to the beam 17 have a required span (l) to which the horizontal tangent to the groove of the top sheave segment 23*t* is established to the mean lateral change (l+g) with arc travel of connections 22*c*. Plane 25 is established to a slope required for the transition of the configured aft wire from an above deck connection with the pivotal beam to a below deck connection with the sheave segment 29. Aft wires extend below deck 26, to an isolated position, limited by framing structures for deck 26 and shell 27, to establish dimensions (j) and (k). Pitch diameter of grooved sheaves have optimal values therefore sheave segments 23*t, b* mounted together on plane 25 establishes a minimum hypothenuse (z) of the triangulation formed by the aft wire being both above and below deck. These determined values (l,j,k,z) together with the barge breadth (a) yield a calculable value (h) of connects 22*c* above deck 26 which may differ from the elevation (i) of beam end connection 43 above deck 26 to possibly require a bracket 44 extending below from the pivotal beam 17 to effect connections 22*c*. Pivotal beam 17 is restrained by stops 34 to miniscule values of angular deflection (B) and with an appreciable span (l) then arc travel and forward pull of either aft wires 22 *p.s.* are approximately equal to establish the angular departure (A) of quadrant 20 having a grooved pitch diameter (d) (see FIG. 17) for (A = Bl ÷ d) with (A) limited within the range for center of pressure of water acting on the rudder to be concentrated along the rudder axis established by rudder stock 21.

FIG. 10 shows the fore and aft travel (e) of connections 22*c* and spacing (f) of sheaves 23*p, s,* from beam 17 for a suitable maximum fleet angle (Q) of wire 22 deflection with grooves of sheave 23*t*. Pedestals 35 for end supports of beam 17 fix the upward facing hardened bearing surface 36 to a limited area for an allowable unit pressure, and provides support for stops 34 limiting beam angular departure (B). The downward facing hardened more extended bearing surface 37 fixed to beam 17 provides the bearing track for arc travel of beam end over support 35.

Mounting pivotal beam 17 by pedestals above deck structure 31 provides headroom for access to the forward gear comprising mooring and anchor lines. Beam end 43 above deck 26 substantially increases the height of the suspension point of towline 11 to lessen immersion below water of the parabolic like curved towline from that immersing with the pivotal beam shrouded by a tunnel below deck. Icing problems likewise have become comparably inconsequential. Coordinated shipyard effort is considerably simplified with less involvement in hull construction.

Figure 1:
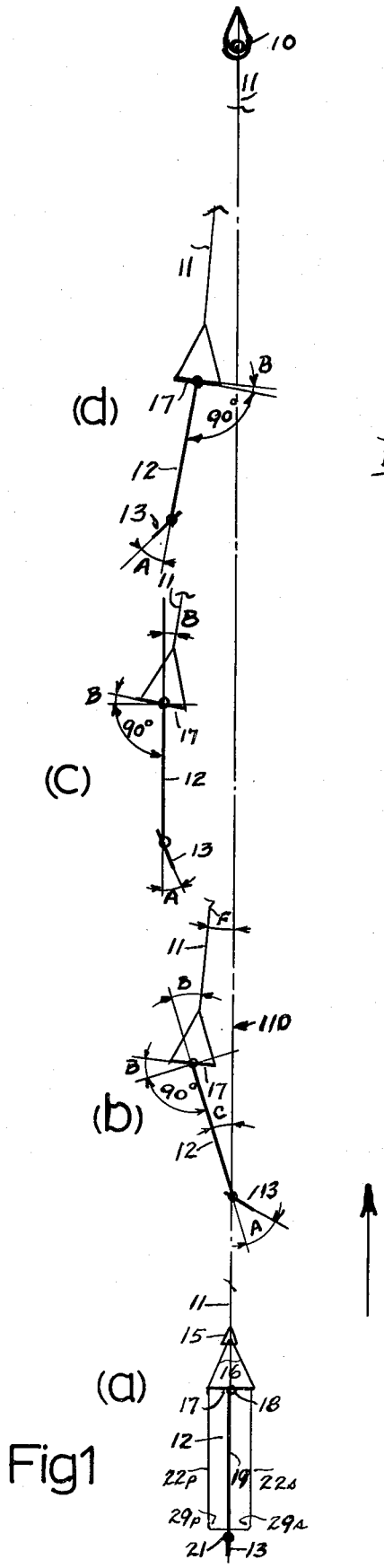
FIG. 1, Arrangement (1), aligned position (a) changes to positions (b, c) with yaw to port establishing a right rudder for return toward course by position (d), for a subsequent repeated aligned position (a) on course, to have avoided overshooting the course with the left rudder reducing to neutral with approach on course.
Figure 2:
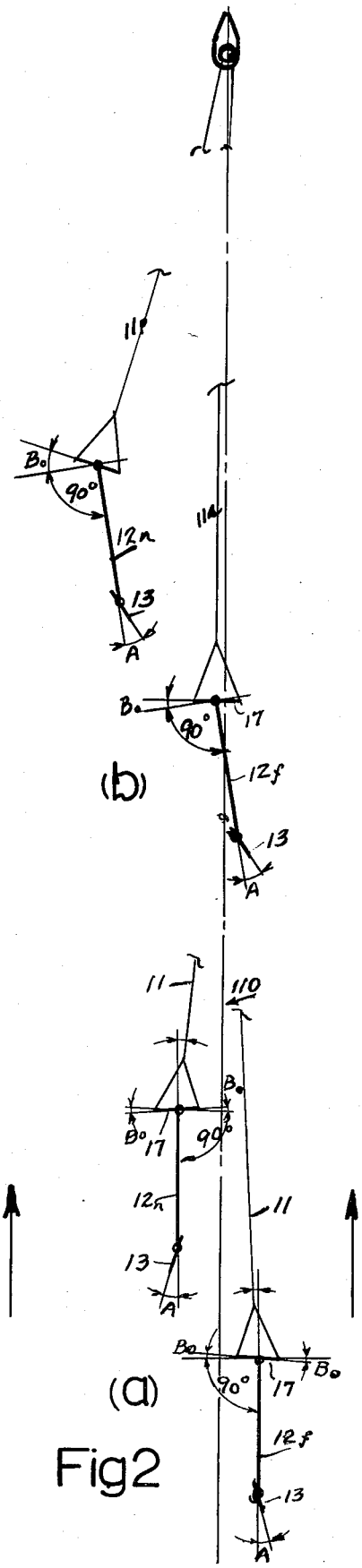
FIG. 2, Arrangement (2), position (a) shows barges (double tow) tracking on course each to a side of the wake centerline: the far barge (f) with slight right rudder and the near barge (n) clear of the more extended towline with left rudder. Position (b) shows both barges at a port yaw for a parallel oblique setting with right rudders for return on course, individually repeating performance (1d) to a reinstated position (a).
Figure 4:
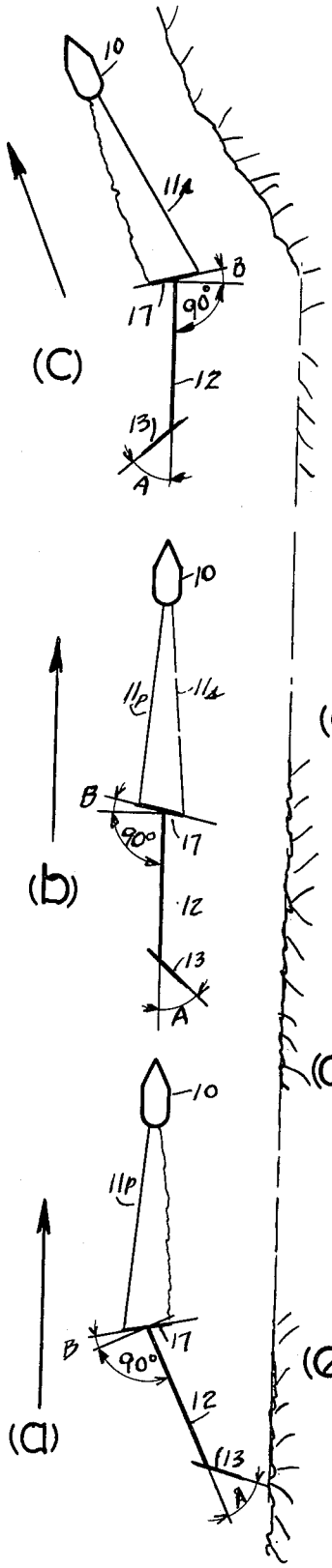
FIG. 4, Arrangement (4), position (a) represents the effect with a single towline of Arrangement (1), and also for Arrangement (2) not shown, with pronounced change in tug heading to starboard with the starboard side bridle leg slack. Maximum right rudder has been set with the towline a direct extension to the barge port side. Position (b) shows the effect of Arrangement (4*b*) to negate the stern "suction" effect in narrow channels with the tow off mid-stream. The starboard towline is relaxed for a right rudder with propulsion by the port towline opposing shear to the far side bank. Position (c) indicates a controlled tow paralleling a near bank with maximum left rudder and the starboard towline tensioned—port towline stack.
Figure 6:
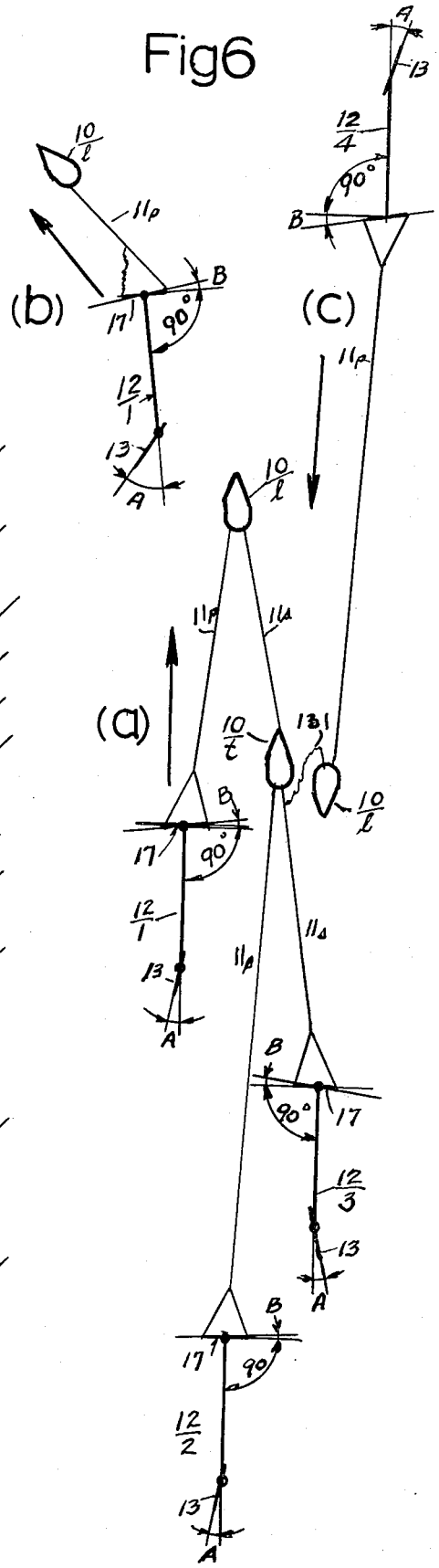
FIG. 6, Arrangement (6), triple tow of barges is an adaptation of Arrangement (2) with two tugs for three barges. Position (a) shows the combined tow as a train on course with the lead tug (l) in tow of a trailing tug (t) close hauled and a barge (1) more distinctly towed. The trailing tug (t) is in double tow of far barge (2) and near barge (3). Position (b) shows tug (l) with barge (1) now close hauled and separated from tug (t) for diversion to a port to exchange barges for regrouping to the train. Tug (l) will have changed, sequentially, Arrangements (1—3—5—3—1) in the interim when not part of the train to indicate the need for apparatus to expeditiously and safely perform numerous changes many times in serving many ports annually. Position (c) shows tag (l) now with barge (4) making an approach to tug (t) to pass the side to which barge (3) is towed whereupon tug (t) passes a lead line to tug (l) to transfer tow of barge (3) to become part of the double tow by tug (l). Said lead line passed between tugs is the extension of an auxiliary short towline 131 which had replaced the normal towline as a performance undertaken in the interim of effecting barge exchange by tug (l). Said lead line passed to tug (l) also provides the means to haul aboard tug (l)

FIG. 11 shows the flounder plate 15, detailed as preferred from several versions accomplishing the same purpose. End fittings of towline 11 and bridle legs 16 mate, being connected together by pins 41 (viewed in FIG. 8). Therefore more of the same pins 41 serve to connect the flounder plate 15 between fittings with holes 38–39 accomodating fittings of towline 11 and a bridle leg shown 16*s*. Slotted hole 40 accomodates the other bridle leg 16*p* with a filler plug 42 match fitting the gap in the slot with the pin 41 in place. Filler plug 42 serves to shorten a bridle leg assembly whereupon with propulsion by the tug, the beam 17 sets to an angular departure (B) to provide an oppositely rotated set of the rudder to angular departure (A) as shown exaggerated in FIG. 2*a*. The offset rudder changes barge heading to a side with the shortened bridle leg to track from midstream of the tug wake. A like assembly with the flounder plate 15 turned upside down establishes a like internally fitted barge to the opposite side of said midstream location. FIG. 2 illustrates this application to undertake double tow of a far barge 12*f* and a near barge 12*n* clear of the more extended towline 11, again either barge to port or starboard as selected. In any case the near barge is the first barge to be taken from the tow. Headings of both barges off course due to external forces are slight and to oblique parallel paths. Turn of barges with change in tugboat heading transpires with the rudder at maximum deflection (A) augmented by a turning couple resulting with the towline pull on a single bridle leg with the beam bearing on the stop 34, per supplemental control Arrangement (4) FIG. 4. As indicated in FIG. 6*c* (see also FIG. 15), an auxiliary towline 131 connected to replace towlines 11 is powered by a capstan 132 aboard the tug in tow of a near barge to be transferred to another tug. A heaving line connected by a haul line to the auxiliary towline 131 is cast to the other tug. A capstan aboard the other tug sequentially brings those connected lines and the flounder plate aboard to replace—the auxiliary line for one of its towlines powered by a traction winch 134 for Arrangement (1) FIG. 1 or Arrangement 2 FIG. 2.

Figure 3:
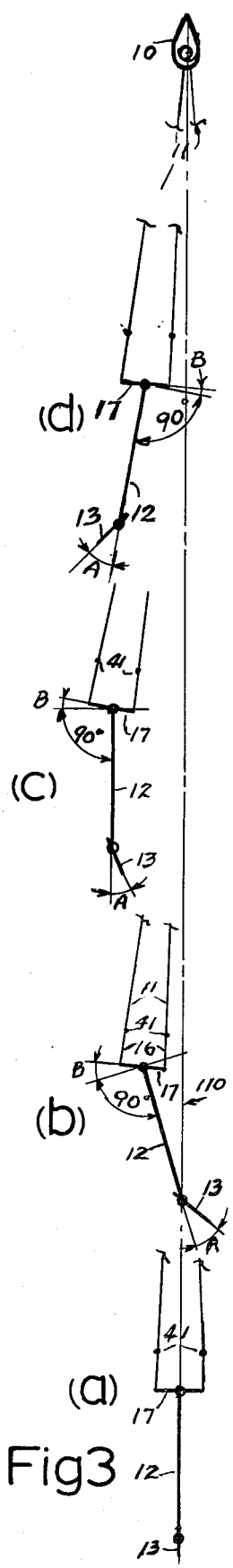
FIG. 3, Arrangement (3)(the subsequent arrangement in sheltered and in narrow tortuous passages from that of FIG. 1 at sea) shows from an aligned position (a) the barge has been diverted to position (b) to avoid an obstruction detected by the tug ahead, with positions (c & d) being again the approach to an on course position accomplished by selectively manipulating the barge rudder.

To effect selective control (Arrangement 3, FIG. 3) cufflink 46 (see FIGS. 12, 13 & 14) serves to engage end fittings of bridle legs 16 *p,s* as an anchor means 112 to assume load imposed with slack-off by towline 11, to allow a rearrangement for direct coupling of a towline to each bridle leg with the flounder plate and cufflink stowed aboard the tug.

Another use of the cufflink serves to reassemble bridle leg end fittings together without the flounder plate to transfer bridle legs to its barge for recovery with exchange of barges left at a port (see FIG. 14).

In FIG. 12, cufflink 46, associated with drill hole 39 and slotted hole 40 of flounder plate 15 is slidably assembled together as two halves, having a first applied cone segment 47 (sided with hole 39) and a second applied cone segment 48 (sided with slot 40) and is held together by strongback 49. Cone segments are formed to seat the conical portion 50 of either bridle socket 53, 54 having saddled the bridle wire 16 by channel 52, laterally clear before being said assembled. First bridle socket 53 and second bridle socket 54 are assembled to flounder plate 15 to an approximate vertex angle of 37° to establish an 18½° angular set of cones of said segments each side of the cufflink axial centerline 55. In FIG. 13 channels 52 of both cone segments mismatch mate with plain faced faying surfaces 56 within channels 52 occurring on transverse centerline 51 common to like cone sections.

Channel walls 57, 58 (with faying surfaces) extend differently from cone sections to establish adequate bearing engagement area 64 aligned parallel to the 18½° angularity of the conical section of cone segment 48. Channel walls 67, 68, establishing channels 52 with faying surfaces 56 along centerline 51, extend parallel with walls 57, 58 respectively to provide interior grooves 60 for engagement with tongue 61 fixed to back of walls 57, 58; so as to be exterior to the channel formed by it. Tongues 61 bridge the span between walls with said assembled two halves to close off channels and transmit strongback compressive force centrally to said area 64. Opposing loads between sockets 53, 54 are contained by the assembled cufflink 46 as specified to be employed.

A pad eye 62 fixed to the back of wall 57 provides for the temporary connection of a trolley wire line removed from flounder plate 15 as subsequently discussed. A pad 63 double drilled and fixed to the back of wall 58 provides for mounting of an anchor chain to be alternatively connecting the cufflink assembly to the tug deck 81 or barge stem 79 (see FIG. 14) as subsequently discussed. Said pad 63 provides the second drill hole for a shackle of two flexible haul lines 135 needed in barge exchange to transfer the cufflink connected bridle legs between tug and barge as subsequently discussed.

FIG. 12 is detailed, for Arrangement (2) FIG. 2, with the filler plug 42 establishing socket 54 for a shortened bridle leg 16*p*. Consequently cone segments have a less bearing engagement area 64 than occurs had the filler plugs been rearranged for like length bridle leg extensions for the fully engaged area 65. Like lettered dimension lines graphically distinguish wall extension and bearing areas associated with its cone section and subscripts identify like member differently arranged.

Figure 5:
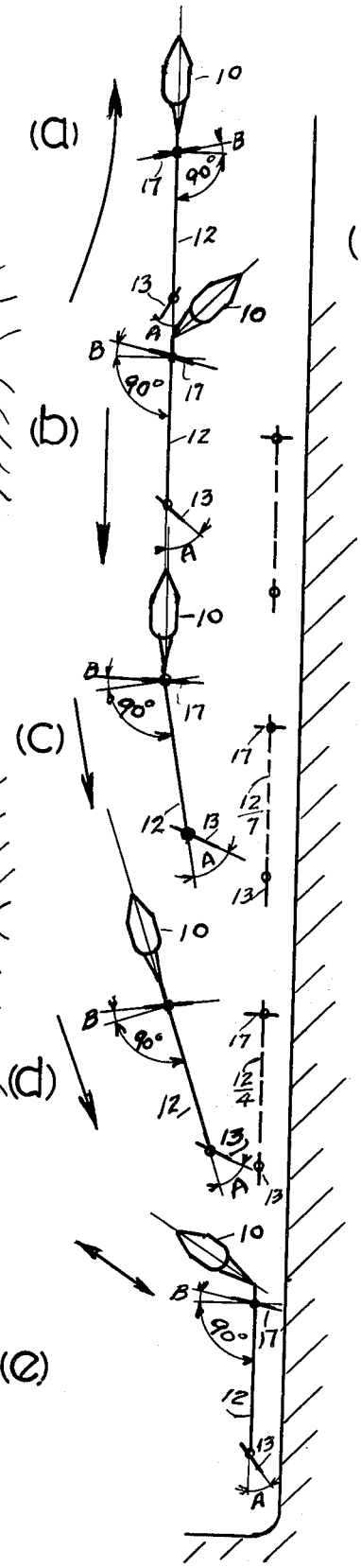
FIG. 5, Arrangement (5), is more illustrative of the backing capability of the integrated tow assumed in approach to a dock and providing unassisted (no other vessel) mooring of barges particularly in contention with restricting conditions and the elements. The method provides for selective alignment or angular set of the said lengthened tug by its bow thrustor with respect the barge position in a jackknife sequence with sternward backing of the barge. Position (a) indicates the forward approach of a dock site to establish a stern spring line and set an anchor when necessary to hold against wind or current forces. Position (b) shows the change in barge angularity as backed by the tug assisted minorly with the barge rudder. Positions (c & d) depend upon the swing of the spring line to pull the barge stern to the dock with the tug alignment altered to bring the barge bow to the dock. Position (d) indicates the arrangement for the completed performance or initial position with a second barge in the exchange practice.

Description of the 'A' frame 70, for Arrangement 5 FIG. 5, includes its special application, appurtenances and multi-purpose function to disclose an improved connection for more positive control of a barge than by conventional means of lashing a tug to a vessel. To facilitate making connection to bear the outboard reach of an 'A' frame to integrate the tug and barge, with both vessels variously loaded with resulting freeboard and differing in response to swells in calm waters, a trolley line wire system 88 provides a guy wire training of the distal clamp end 77 to a preselected heavy duty padeye 78.

FIG. 14 shows main lengthened chord members 71, 72 braced by web members 73 to establish a structure having cantilever truss like characteristics resisting horizontal components of loading. The more broadly spanned end of main members 71 (see FIG. 15) are pin connected 74 to the tug stern rail 75, whereas the distal flanged end 76 extended by articulatively operated clamp means 77 is engaged for universal connection to one of a series of heavy duty padeyes 78 fixed to the barge stem 79, selected per Arrangement (5).

A portable derrick means 130 furnishes a winch operated wire 80 to counter weight support the mid length of 'A' frame 70 when outboard, and to effect pivotal replacement of the 'A' frame 70 to a most time spent inoperative prone position above the tug stern deck 81. Catwalk 82, built upon web members 73, provides means of access between tug and barge: to board the barge in port via a pole ladder (per Arrangement 5), and the means to alter location of connection 83 of the stub length end 84 of a trolley line wire portion shown loosely extending (in FIG. 7) to flounder plate connection 85. FIG. 8 shows trolley line wire coupling 86 joining stub length 84 to an extendable portion 87 for a trolley wire system 88 accomodating various lengthening of dual towlines for selective control, Arrangement 3 FIG. 3. (FIG. 8 shows dual rudders for conditions when the barge longitudinal centerline 19 is occupied by other means such as a conveyor for stern discharge of cargo.)

Flounder plate 15 provides the intermittent engagement means, as in Arrangement (1) FIG. 7 when the 'A' frame is in inoperable position, to become the accessory means as well, to effect the eventual trolley-line wire system 88 by sustaining contact with the barge stem 79 immediately above heavy duty padeye 78. When changing from Arrangement (1) to Arrangement (3) and the flounder plate 15 is to be stowed aboard the tug, accessibility is retained by changing the connection of the stub wire from the flounder plate to extendable portion 87 of the trolley-line wire system 88. Thereafter for Arrangement (5) the wire system 88 is separated only to receive shackle 89, pin connected to clamp means 77.

While pivotally changing 'A' frame position from said deck 81 to an outboard suspended reach effected by winch operated wire 80, the slackened trolley wire system 88 is tensioned to provide a cable-way-like guidance of clamp 77 to selected padeye 78 resulting with ride of shackle 89 on the wire system 88.

In FIG. 16 articulative clamp means 77 comprises: body 90 with drilled holes for pins 91, a linkage means 93, activated to cause jaws 92 to pivot about pins 91, comprises a tee formed member 94 pin connecting dual intermediate links 95 which in turn are pin connected to lever arm portions 96 of jaws 92. With jaws 92 in closed position 97 around padeye 78, said dual intermediate links 95 are axially aligned with tee member 94 interposed to establish a self-locked in columnar position 105. Compression in frame 71 to back the barge is transmitted through body portion 98 to padeye 78 with jaw portion 99 therebetween. Tension in frame 71 to tow the barge is transmitted to padeye 78 by jaws 92 locked from being pivotally opened by counteracting lever arm portion 96 pin connected to linkage means 93 in columnar position 105 opposing forces acting on the enclosing jaw position 100.

A wire 101 with socketed end 102 is pin connected to shank portion 103 of tee member 94 with said wire 101 tensioned by a remotely located lever 104 to draw member 94 from a columnar position 105 to an extreme alternative position for axial alignment 106 of intermediate link 95 with pin 91 and pin connecting tee and intermediate link 94, 95 respectively for an extreme open jaw position 107.

Socket 102 is secured to a bar 108 extended through guide slots 109 formed through walls of body 90 for connection to compression set spring assemblies 111 to load the columnar position 105 against body portion 98 to secure said locked position against inadvertant jaw opening. Tensioning said wire 101 represents increased compressive loading of spring assembly 111 to open jaws for position 107.

Previous discussion for the need of cufflink 46 and use of 'A' frame 70 with description of their component parts and assembly permits further disclosure that said anchor means 112 comprises a chain 113 (see FIG. 14) fixed to said padeye 63 and to be shackled to a like padeye fixed to the tug deck 81 or alternatively to another like padeye aboard the barge. Thus the anchor means 112 secures the cufflink assembly aboard the tug whilst towline arrangements are being altered or to store the bridle above water as catinary like curved cables between upper-reaching connections at the barge stem 79 and beam ends 43.

With the assembly of bridle legs to cufflink 46 to said store the bridle, then coupling 86 connecting the trolley line wire system 88 is rearranged to free extendable part 87 for stub part 84 to be connected to said padeye 62 whereupon system 88 retains its potentiality with exchange of barges.

The rudder 13 is returned to neutral when the towline is relaxed by a counterweight linkage means 121 (see FIG. 17) with a tiller arm 122 extension of the rudder quadrant 20. The two adjustably elevated counterweights 123 are contained to a (live) position (b) immediately above and free of its vertical support 137 with the rudder at neutral. Said neutral was established by adjustment and pretension of aft wires 22 to an ascertained length between connections 22*c*, 30 with the pivotal beam 17 and rudder quadrant 20.

The pair of said aft wires 22 respond differently when one is pulled forwardly by its connection 22*c* with the pivotal beam 17, as a desirable consequence of wire characteristic possessing exceptional elastic stretch. With pull on one wire connected to the beam portion moving forwardly, that side wire is loaded by frictional drag of both aft wires, mechanical friction of rudder stock bearings and the dead weight of one counterweight (the other at rest).

The corresponding elastic stretch in the loaded aft wire lessens turn (A) of the rudder quadrant 20 than factored measurable to the beam angular deflection (B), consequently said ascertained length has increased for the loaded side wire and lessened for the other wire to lessen its pretension (with less extension)—thus, lessens pretension to both wires 22. Ultimate loading of aft wires are only moderately more than in a pretensioned neutral state—made sufficient to retain the less tensioned wire engagement in arc contact with associated grooves.

Access to man the barge at sea is essential for unhindered performance, particularly when loosened deck loads (lumber drying out) must be secured or cargo shift develop a barge 'list' which creates a tendency for the barge to sheer for a less stable course. Manning the barge, then, provides the means to reestablish automatic directional stability of the barge to compensate for a listed condition by adjustment means 30 at the rudder quadrant 20 to simply establish a compensating rudder set (A), much as established by a ship to avert sheer caused by an aft propeller.

A pivotal boom 114 stayed 115 to extend beyond the barge stern 116 serves as a monorail in emergency to board the barge with a safely distant approach of the tug 10 to snag a stirrup fitted trolley 117, thereby released, to transfer a man to and from the barge. In port the pivotal boom is drawn in and secured to the barge stern 116 immediately below deck level 26.

The pivotal boom has a more utilitarian purpose by trailing a float 118 by a leader line 119 likewise snagged to provide the means to strip away extensions to an emergency towline 120 contained in a rope locker 136 and separately bridled to the pivotal beam 17 for engagement to said capstan 134 on the tug stern deck 81 to reinstate automatic barge control of a breakaway barge.

Intercoastal routes necessitate traverse of canals with code requirements satisfied in the present application, including: a pivotal buttress 124 erected to a vertical cantilever operable position 125 from a horizontal inoperable position 126, then stowed within confines of the barge stern 116 and below deck level 26. Said buttress provides the means for a tug to push and control the stern end of the barge in constricted shallow waters.

The buttress is braced 127 from deck 26 to maintain its vertical posture and is pivotally swung between positions by a block and cable means 128 with said horizontal position 126 established by locking means 129. The buttress serves at sea in emergency to act as a skeg (drag) to supplant an inoperative rudder 13 with that arrangement undertaken with the provision to board the barge via pivotal boom 114.

Said boom 114 and buttress 124 stern confinement in port allows for stern arrangement of cargo transfer to and from the barge, complimentary with sternward approach to moor the barge.

The foregoing is believed to have clearly disclosed basic patent requirements to be novel, useful and operable; distinguishing the latter in the general description as the needed means to accomplish prescribed arrangements. Novelty is established by detailing arrangement of barges in accomodations with ports of call. Usefulness is demonstrated by self-reliance to adjust with confrontations at sea and coastal inlets to complete a voyage. Furthermore, this application reveals only preferred arrangements with each retaining the basic concept, applied to cope with changing requirements, for example: configuration of said aft wire, mounting and form of a rudder or conformation of vessel. Outfitting of tug and barge is understood to comply with the need for global voyages and coastal inlet passages. Provisions to cope with mishaps have been included as pertinent to the concept that voyages are completed unassistedly and unhindering to traffic.

What is claimed is:

1. In a combination comprising:

(a) a tug to impart propulsive force by a towline to a barge having a rudder to maintain barge directional stability with the tug heading; and (b) a segmented linkage mechanism connecting said towline and rudder to turn the rudder to an angular deflection from a neutral position when the towline and barge longitudinal alignment deviates;

an improved arrangement affording a simple means to mount the linkage mechanism while providing accomodations to alter member relationship for a rudder response to accommodate conditions encountered, comprising:

(1) a propulsive force transmitting forward segment having a flounder plate connected to the trailing end of said towline to form a vertex connection between the towline and bridle legs connected to the ends of a beam which is pivotally mounted to a structure fixed above the barge deck to impart propulsive force along the barge longitudinal centerline;

(2) a bearing supported rudder stock pivotally mounting the rudder, said stock extending upwardly from the rudder to a rudder quadrant contained in a compartment disposed below said deck;

(3) a pair of aft wires extending from forward end connections with the pivotal beam around horizontally disposed grooved sheave segments within the compartment for an athwartship reach past each other to adjustable connections with the pivotal rudder quadrant;

(4) stops to provide means to transmit towing forces from the beam to one side or the other of the barge and limit pivotal movement of the beam to restrict rudder angularity (A) within a range containing the center of water pressure whereby force imparted to the rudder by said pressure is transmitted along the pivotal axis of the rudder to obviate hydrodynamically developed torsional loading to said mechanism; and, (5) a pair of vertically spaced grooved sheave segments, each of said aft wires extending around one of said pairs whereby said wires are directed from the above deck location of the beam to a below deck disposition.

2. An improved arrangement according to claim 1, wherein the diameter of the rudder quadrant relative to the spacing of the end connections of the aft wires to the beam is such as to provide a ratio of rudder turning relative to beam turning in the range of 6 to 1 and 10 to 1.

3. An improved arrangement according to claim 1, wherein:

(a) a braced pedestal, with a vertical trunnion establishing the central mounting of the pivotal beam to said structure fixed above the barge deck, provides an elevated island support of the pivotal beam to accommodate said sheave segments;

(b) a pair of braced pedestals disposed near ends of the pivotal beam provide elevated island supports for the stops; and, (c) said pair of pedestals provide bearing supports for the ends of the beam.

4. An improved arrangement according to claim 3, wherein:

(a) the pivotal beam is disposed to a least likely cargo area and mounted to provide free access to all deck gear forward of the beam; and, (b) disposition of the pivotal beam end well above the deck provides for a higher towline suspension point to lessen the amount of towline immersed under water to reduce frictional drag of the towline and power requirements of the tug.

5. In a combination comprising:

(a) a tug to impart propulsive force by a towline to a barge having a rudder to maintain barge directional stability with the tug heading; and, (b) a linkage mechanism, connecting said towline and rudder to turn the rudder to an angular deflection needed to maintain a required barge offset position from midstream of the tug wake for directional stability with the tug heading;

an improved arrangement accommodating the double tow of barges by a tug with dual towline extended to trailing near and aft barges with the more extended towline clear of the near barge, comprising:

(1) a flounder plate connected to the trailing end of one of said towlines to form the vertex connection of bridle legs conveying an equal share of forces to the ends of a pivotal beam mounted on one barge to impart propulsive forces along the barge longitudinal centerline;

(2) a linkage wire connected between the beam and rudder of said one barge, said wire having tension and length adjustment means to fix the pivotal beam at right angles to the rudder when the rudder is aligned with the barge longitudinal centerline;

(3) a first drilled hole in the flounder plate for receipt of a pin connection on the end of the towline;

(4) a second drilled hole and a slotted hole in the flounder plate for receipt of pin connections on the ends of the bridle legs; and, (5) a filler plug adapted to be positioned within the slotted hole to adjust the position of the pin connection received in the hole and thus adjust length of the bridle leg between said connection and the beam.

6. An improved arrangement according to claim 1, wherein said linkage mechanism also comprises:

(a) a tiller arm extension on the rudder quadrant; and, (b) counterweights connected to either side of said arm to normally bias the rudder to a neutral position.

7. An improved arrangement according to claim 1, wherein outfitting of the barge includes precautionary means needed to safely and expeditiously cope with emergencies at sea and moor a barge, comprising:

(a) a pivotal boom stayed to extend beyond the barge stern to serve as a monorail to contain at its distal end a stirrup fitted simple trolley adapted to be snagged by a boat hook from a tug safely distant from the barge and to be used to convey a man between the tug and barge;

(b) a float trailing from the boom by a leader line, said line being adapted to be snagged to provide means to strip away an arranged extension of an emergency towline separately bridled to said pivotal beam; and, (c) a pipe buttress stowed against the barge stern, said bruttress being extensible to provide a cantilevered member by which a tug may push the barge in sheltered waters.

* * * * *